US006550198B1

(12) United States Patent
Endo et al.

(10) Patent No.: US 6,550,198 B1
(45) Date of Patent: Apr. 22, 2003

(54) WALL CONSTRUCTION

(76) Inventors: Youichi Endo, 20 Weil Pl., Cresskill, NJ (US) 07626; Shozo Endo, 7-23-10 Shakujii-Dai, Nerimaku, Tokyo (JP); Shuji Endo, 7-23-10 Shakujii-Dai, Nerimaku, Tokyo (JP)

( * ) Notice: Subject to any disclaimer, the term of this patent is extended or adjusted under 35 U.S.C. 154(b) by 0 days.

(21) Appl. No.: 09/934,362

(22) Filed: Aug. 21, 2001

(51) Int. Cl.[7] ..... E04B 1/00; E04B 1/10; E04B 2/70

(52) U.S. Cl. ..... 52/271; 52/286; 52/581; 52/592.6

(58) Field of Search ..... 52/270, 284, 273, 52/271, 286, 581, 592.6, 292, 293.1, 481.1, 481.3, 645, 690, 745.1, 582.1

(56) References Cited

U.S. PATENT DOCUMENTS

| | | | | | |
|---|---|---|---|---|---|
| 1,399,320 | A | | 12/1921 | Raudabaugh | |
| 2,388,927 | A | | 11/1945 | Moor, Jr. | |
| 2,493,435 | A | * | 1/1950 | Archambault | 46/26 |
| 3,004,364 | A | * | 10/1961 | Benkelman | 46/25 |
| 3,364,646 | A | | 1/1968 | Snider | |
| 3,490,188 | A | | 1/1970 | Troutner | |
| 3,604,146 | A | * | 9/1971 | Wlner | 46/26 |
| 5,095,671 | A | * | 3/1992 | Mitani | 52/210 |
| 5,493,836 | A | * | 2/1996 | Lopez-Munoz | 52/602 |
| 5,802,780 | A | * | 9/1998 | Hammerschlag | 52/105 |
| 5,867,963 | A | * | 2/1999 | Hershey | 52/729.4 |
| 6,014,842 | A | * | 1/2000 | Matsubara | 52/79.12 |
| 6,023,897 | A | | 2/2000 | Leslie et al. | |
| 6,047,503 | A | | 4/2000 | Kost | |
| 6,158,189 | A | | 12/2000 | Lau | |

* cited by examiner

*Primary Examiner*—Jeanette Chapman
(74) *Attorney, Agent, or Firm*—John P. White; Cooper & Dunham LLP

(57) ABSTRACT

A wall construction comprises block members or sections stacked vertically about five high and abutting horizontally to form a wall. Each block member or section comprises a top plate, bottom plate and two side studs. The block members are attached side by side by fastening plates on the top and bottom which overlap adjacent blocks, including one top fastening plate which overlaps the top plates of two adjacent blocks, and a bottom plate which overlaps the bottom plates of two adjacent blocks. The vertical components may be 2×4 dimensional wood pieces on the order of 15–20" long, and the horizontal components about 30–40" long. Steel studs may be used instead of wood pieces, and horizontal components may be up to eight feet long.

26 Claims, 7 Drawing Sheets

WALL CONSTRUCTION

BACKGROUND OF THE INVENTION

The present invention relates to wall construction for buildings and houses and the like, and preferably to wall construction using relatively short vertical framing members or sections compared to overall height of a wall.

Masonry construction for building walls has been used for a long time, and is particularly strong, being based on a simple principle of considering only vertical compression forces. Such masonry walls avoid the buckling problem associated with walls made of vertically long and relatively slender materials such as wood studs and columns. However, masonry walls are generally heavy and the walls are relatively thick.

Wall construction using wooden or steel studs is based on different structural concepts, such as columns, frame members and so on, which structural concepts are generally more complicated than that of masonry construction. The complications are due mainly to the use of vertically long and slender materials, such as dimensional lumber (e.g., 2×4's and 2×6's) or steel studs, and the design must take into account possible buckling of these frame members.

Of course, wooden and steel wall construction is generally of less weight than masonry. Wooden wall construction also uses different, and perhaps more precious (in some areas) natural resources, such as dimensional lumber of about eight feet in length.

SUMMARY OF THE INVENTION

The present invention provides a wall construction made of box like members or sections, preferably made of wooden or metal materials, without the necessity of considering complicated structural details. This is done by applying relatively simpler masonry construction principles to wooden and steel stud construction materials. According to the present invention, one has to consider generally only compression forces of the building, like that of a masonry building, even though the primary material is preferably wood, metal or other material other than masonry.

The present invention achieves this by avoiding the use of vertically long and slender materials such as eight foot dimensional 2×4" or 2×8" lumber or eight foot steel studs in the vertical orientation.

Another advantage provided by the invention is that one can use wooden resources more efficiently than conventional wooden constructions because the invention uses relatively short component materials. For example, the use of long timber is not needed, and instead 2×4 lumber on the order of 15 or 20" long can be used enabling use of wood residues heretofore largely unusable, thus saving precious natural resources.

According to the present invention a wall construction is provided, comprising block sections arranged side by side horizontally, and stacked vertically to form the vertical extent of a wall, each block section defining a central block opening, wherein said side side block sections are joined by fastening plates which connect at least two adjacent block sections.

According to the present invention a wall construction is provided, comprising block members arranged side by side horizontally, and stacked vertically to form the vertical extent of a wall, each block member comprising a bottom plate, a top plate and two side studs defining a central block opening, wherein said side by side block members abut each other and are joined by fastening plates which overlap the top plates and bottom plates of abutting block members.

In one embodiment, the bottom plate, top plate, side studs and fastening plates of each block member are preferably made of wood pieces. The wood pieces are preferably pieces of 2×4" dimensional lumber. The side studs of each block member are each preferably about 15–20" in length; and the bottom plates and top plates are each preferably about 30–40" in length. The number of block members stacked vertically in one wall construction is preferably about five, such that for a wall 8 feet or 96" high, each block member would be about 19" high.

The overlapping fastening plates are preferably joined to the block members by fasteners. The fasteners are preferably dowels which are inserted in aligned holes in the top and bottom plates, and fastening plates.

The block members may be substantially free of support members in the central block openings, or may have a vertical and/or horizontal brace in the central block openings.

The vertical brace may comprises a vertical wood piece, and the horizontal brace may comprise a horizontal wood piece.

The brace may comprises a panel extending substantially throughout the entire central opening.

According to another aspect of the invention a wall construction is provided, comprising block members arranged side by side horizontally, and stacked vertically about five block members high to form the vertical extent of a wall, each block member comprising a bottom plate, a top plate and two side studs defining a central opening, wherein said side by side block members abut each other and are joined by fastening plates which overlap the top plates and bottom plates of abutting block members, said bottom plates top plates, side studs and fastening plates being made of 2×4" dimensional lumber wood pieces, said wherein said fastening plates are attached to the fastening plates by fasteners.

The fasteners may be dowels inserted into aligned holes in the top and bottom plates, and fastening plates.

Each of the block members may be substantially free of support members in the central openings, or may have a brace in the central block opening. The brace may be a panel extending substantially throughout the entire central block opening.

The brace may also be a vertical brace member extending between the top plate and bottom plate, and may include a horizontal brace member extending between the side studs.

DETAILED DESCRIPTION OF THE PREFERRED EMBODIMENT

Figure 1:
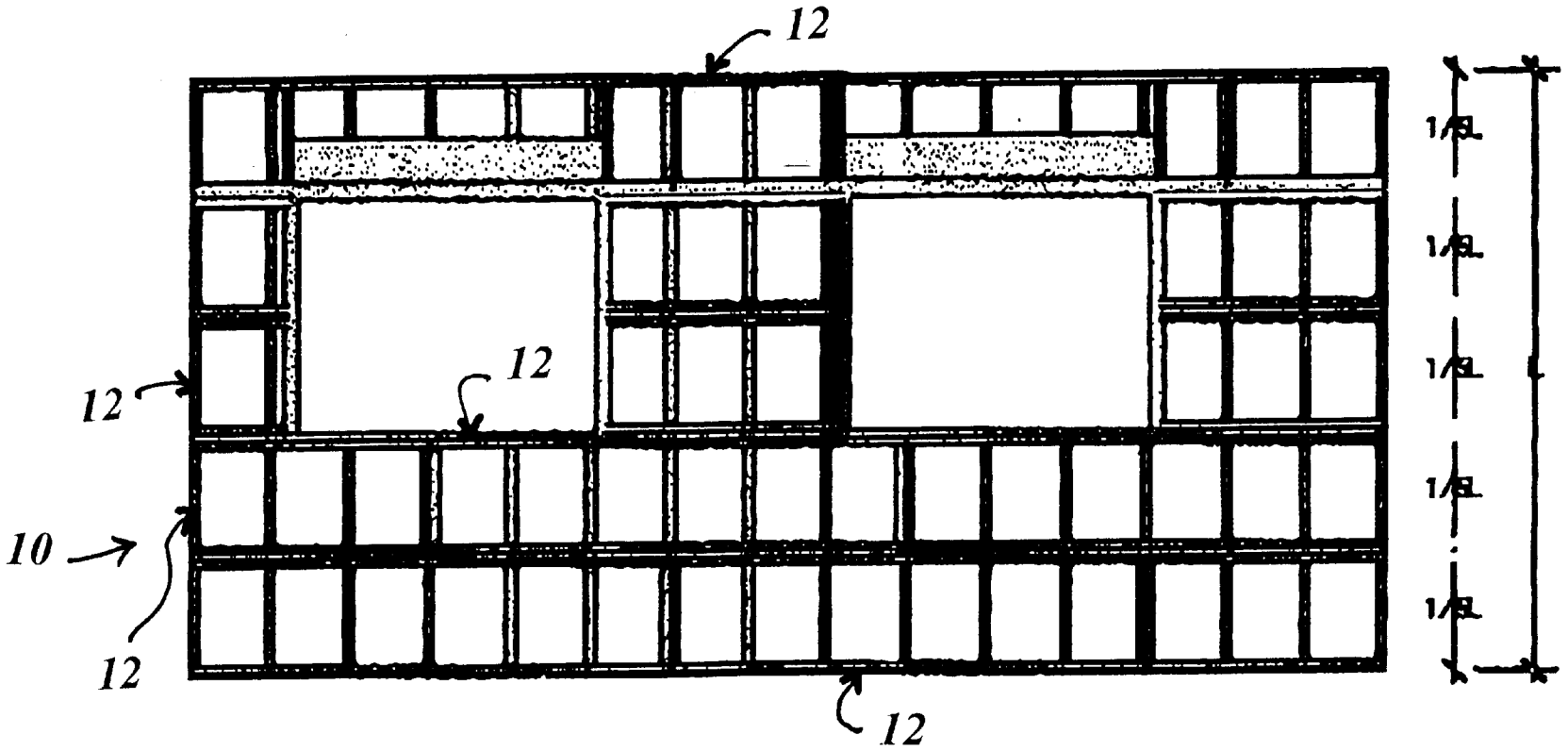
FIG. 1 is an elevational view of a wall construction according to the invention.

According to the present invention a wall construction is provided, comprising block sections arranged side by side horizontally, and stacked vertically to form the vertical extent of a wall, each block section defining a central block opening, wherein said side by side block sections are joined by fastening plates which connect at least two adjacent block sections.

According to another aspect of the present invention a wall construction is provided, comprising block members arranged side by side horizontally, and stacked vertically to form the vertical extent of a wall, each block member comprising a bottom plate, a top plate and two side studs defining a central block opening, wherein said side by side block members abut each other and are joined by fastening plates which overlap the top plates and bottom pllates of abutting block members.

The bottom plate, top plate, side studs and fastening plates of each block member are preferably made of wood pieces. The wood pieces are preferably pieces of 2×4" dimensional lumber. The bottom plate, top plates and side studs of each block member are each about 15–20" in length. The number of block members stacked vertically in one wall construction is preferably about five.

The overlapping fastening plates are preferably joined to the block members by fasteners. The fasteners are preferably dowels which are inserted in aligned holes in the top and bottom plates, and inserted in aligned holes in the top and bottom plates, and fastening plates.

The block members may be substantially free of support members in the central block openings, or may have a vertical and/or horizontal brace in the central block openings.

The vertical brace may comprises a vertical wood piece, and the horizontal brace may comprise a horizontal wood piece.

The brace may comprises a panel extending substantially throughout the entire central opening.

According to another aspect of the invention a wall construction is provided, comprising block members arranged side by side horizontally, and stacked vertically about five block members high to form the vertical extent of a wall, each block member comprising a bottom plate, a top plate and two side studs defining a central opening, wherein said side by side block members-abut each other and are joined by fastening plates which overlap the top plates and bottom plates of abutting block members, said bottom plates top plates, side studs and fastening plates being made of 2×4" dimensional lumber wood pieces, said wherein said fastening plates are attached to the fastening plates by fasteners.

The fasteners may be dowels inserted into aligned holes in the top and bottom plates, and fastening plates.

Each of the block members may be substantially free of support members in the central openings, or may have a brace in the central block opening. The brace may be a panel extending substantially throughout the entire central block opening.

The brace may also be a vertical brace member extending between the top plate and bottom plate, and may include a horizontal brace member extending between the side studs.

FIG. 1 shows a wall construction 10 according to the invention, wherein a wall construction has a plurality of boxes or blocks 12 arranged horizontally and vertically, except for the window openings. The blocks are sized so that each one is about ⅕ the height of a wall. For a wall about 8 feet high or 96", each box will be about ⅕ that size, such as about 19", or can be 15 to 20" or on that order. Of course the wall can be built with the number of boxes being other than 5 high, such as 3, 4, 6 or 7, for example.

Figure 2:
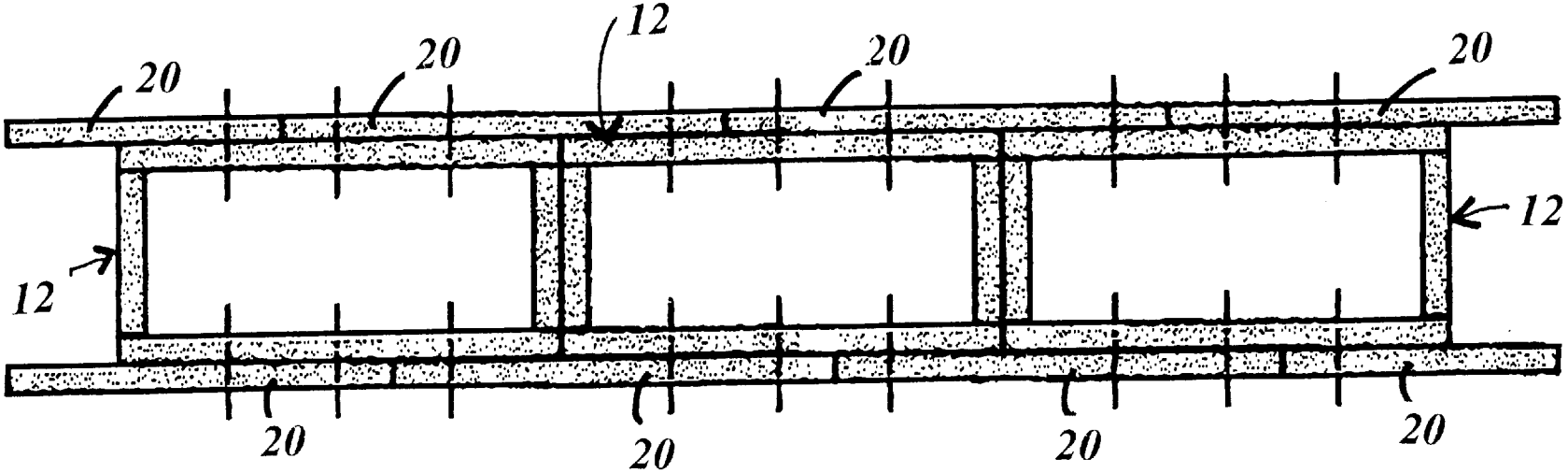
FIG. 2 is an elevational view of one tier or horizontal section of the wall construction of FIG. 1.

FIG. 2 shows a portion of a vertical tier wherein three boxes or blocks 12 arranged side by side. Of course the number of boxes or blocks in a vertical tier depends on the overall length of the wall and the selected width of each box.

Figure 3:
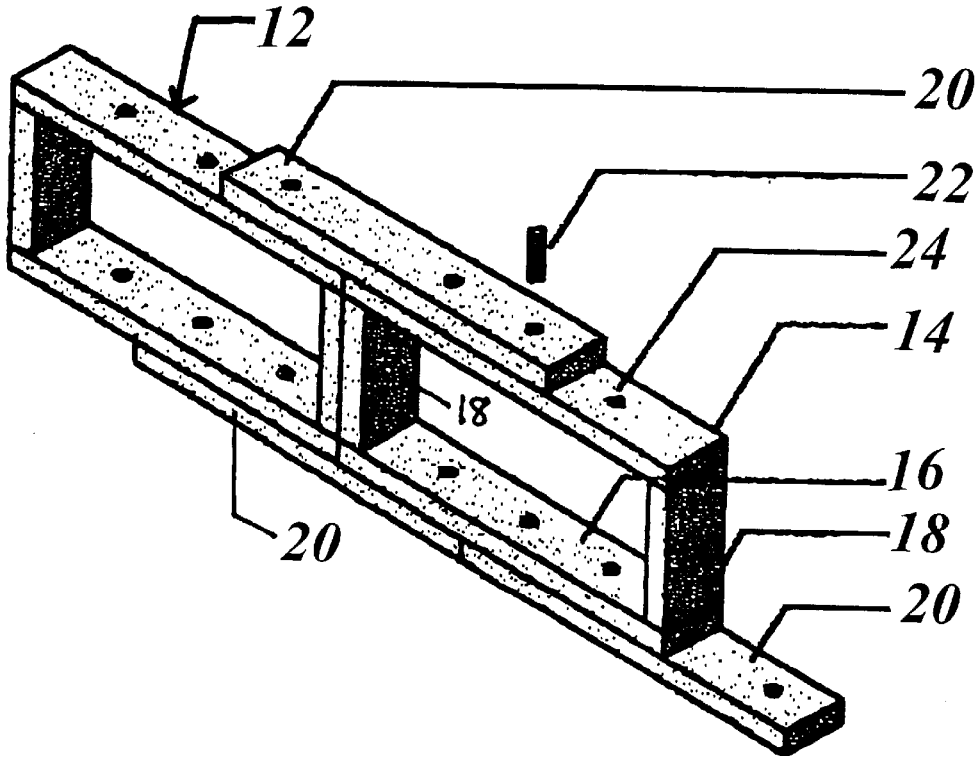
FIG. 3 is a perspective view of part of the horizontal tier of FIG. 2.

FIG. 3 shows how two boxes or blocks 12 are joined together side by side. Each box or block comprises a top plate 14, a bottom plate 16, and two side studs 18 and may be connected by nails or similar fasteners. The boxes 12 are arranged to abut each other side by side, and are joined along their top and bottom by fastening plates 20. The boxes or blocks 12 may be connected to the fastening plates 20 by dowels 22 which pass through holes 24 formed in the fastening plates 20 and top and bottom plates 14, 16. Alternatively nails or other fasteners such as screws can be used. A fastening plate 20 overlaps the junction of the two adjacent blocks. The fastening plate 20 can be about the width of one box in length, or can be longer as long as it overlaps at least one box junction (of two adjacent boxes).

The fastening plates 20 will go around the perimeter of a building or house, except at the openings for the windows and doors and the like.

Figure 4:
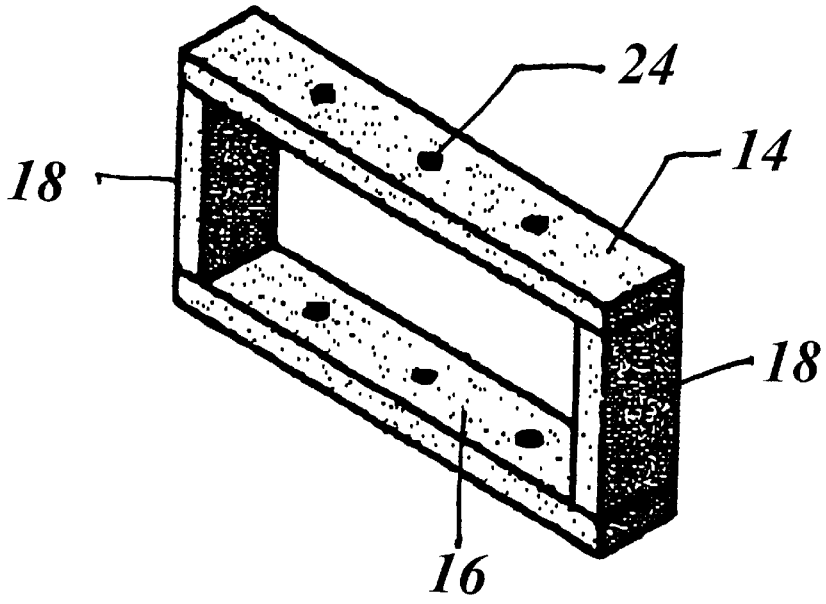
FIG. 4 is a perspective view of one embodiment of a component box or block according to the wall construction of the invention.

FIG. 4 shows a perspective view of one standard unit block or box 12 according to the invention, comprising a top plate 14, a bottom plate 16, and two side studs 18. The top and bottom plates 14, 16 have holes 24 formed therein to receive fastening dowels 22. In this block, no internal bracing or supports are provided.

Figure 5B:
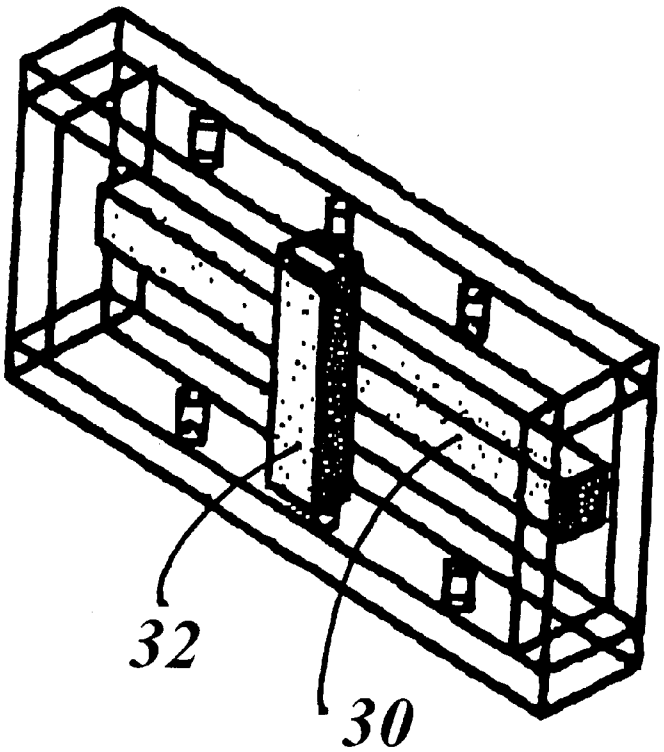
FIGS. 5A and 5B show a perspective view oft a variation of the component box of FIG. 4, with FIG. 5B shown with the top and bottom plates and side studs broken away for illustration.
Figure 5A:
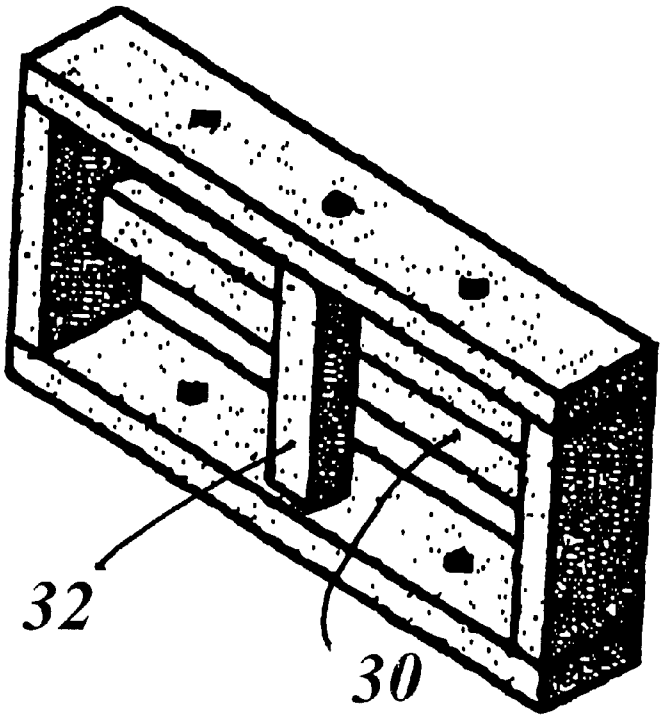

FIGS. 5A and 5B show a unit block or box 12 having internal bracing, in the form of a horizontal support 30 and vertical support 32, which may be in the form of 2×2 dimensional lumber, or 2×4 dimensional lumber turned so that both supports can fit inside the box 12 and not protrude beyond the front face or back face of the box 12.

Figure 6B:
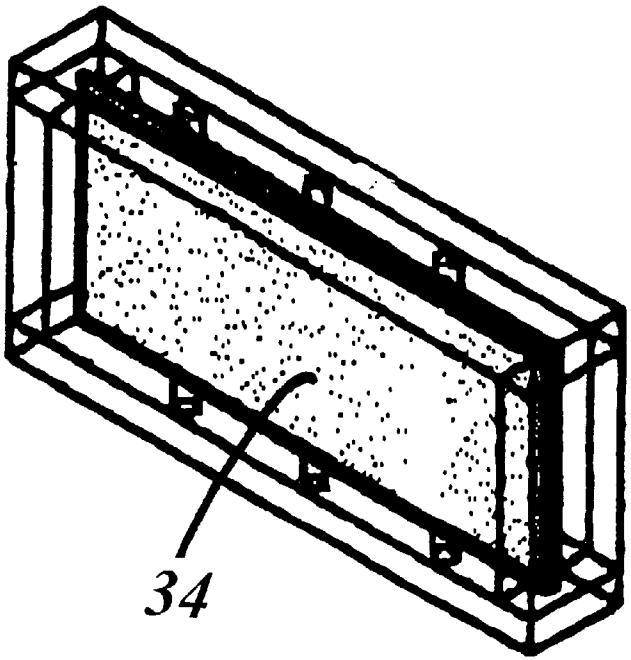
FIGS. 6A and 6B show a perspective view of another variation of the component box of FIG. 4, with FIG. 6B shown with the top and bottom plates and side studs broken away for illustration.
Figure 6A:
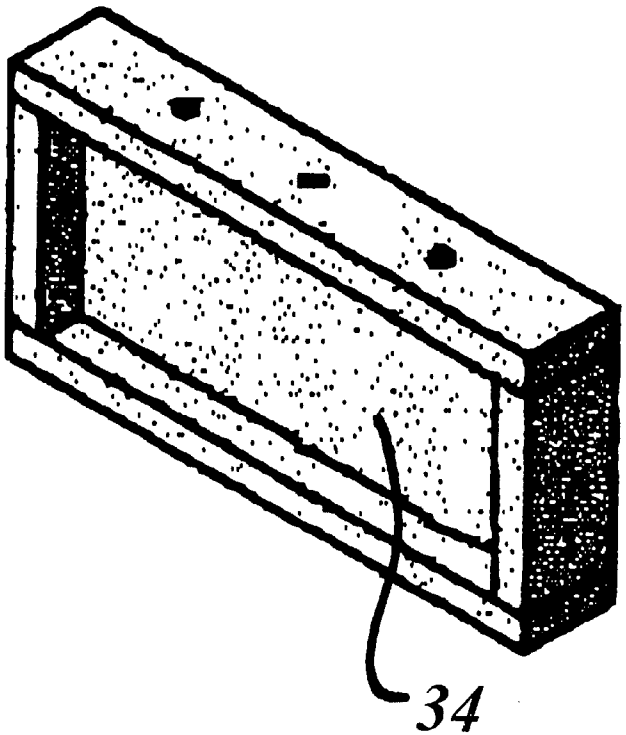

FIGS. 6A and 6B show a unit block or box 12 having internal bracing in the form of an internal panel 34 extending the full horizontal and vertical extent of the interior of the box or block. The bracing can be flush with either face of the box or block 12, or can be located inwardly of the face, such as midway between the faces.

Figure 7:
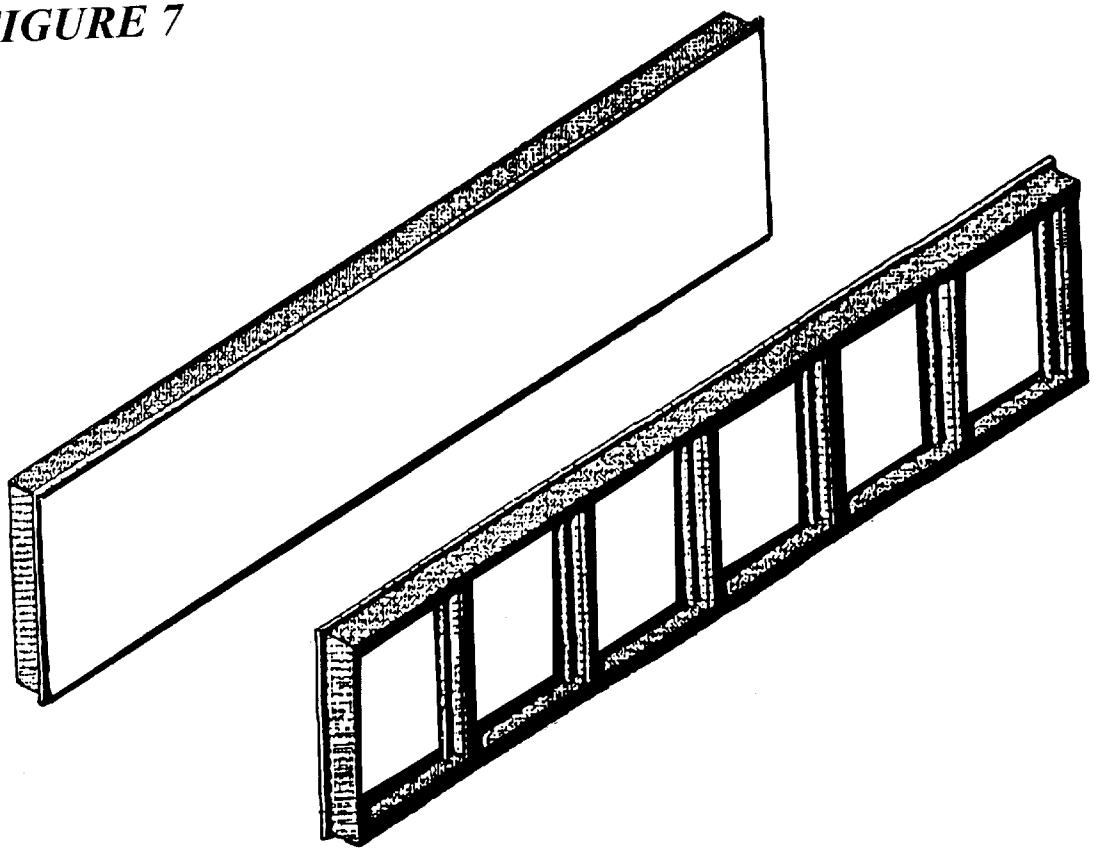
FIG. 7 is a perspective view of a variation using metal studs.
Figure 8:
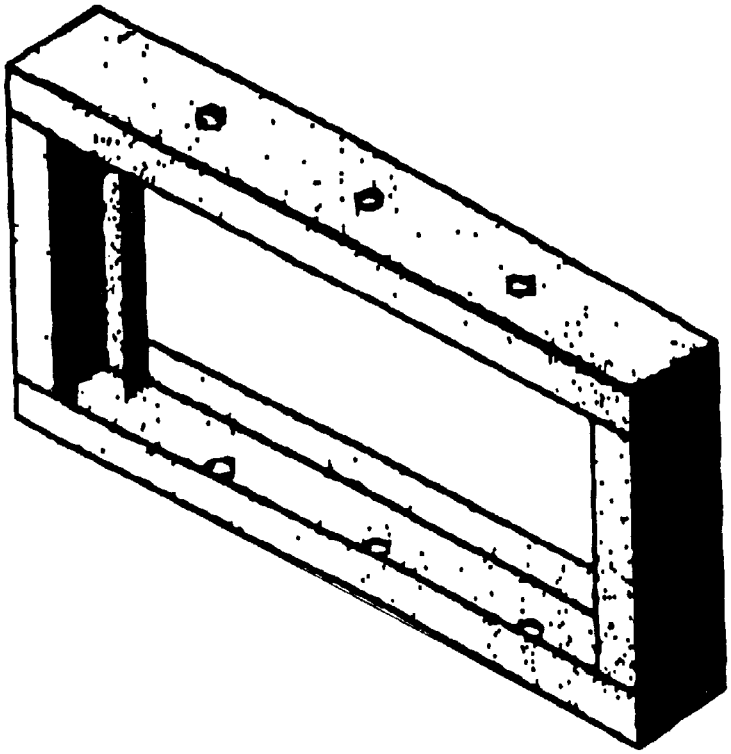
FIG. 8 is a perspective view of a component block or box of a metal stud variation.

FIG. 7 is a perspective view of a variation of a unit made using metal studs, formed by two horizontal eight foot studs, with vertical studs each about 15–20" high, to form six horizontal block sections. The block sections may be formed of one metal stud bent at 90° four times to form a box or block section, or formed of two sides, a top plate and a bottom plate, as shown in FIG. 8, and then the boxes are joined together side-by-side and vertically. Top and bottom plates may connect the adjacent boxes similar to the arrangement for the embodiment shown in FIG. 2. Five of the units shown in FIG. 7 may be stacked vertically to form a wall.

One embodiment of a wall construction according to the invention has been shown and described. Variations may occur to those skilled in the art and the invention is not limited to the embodiment disclosed, but is defined only by way of the appended claims.

We claim:

1. A wall construction, comprising block members arranged side by side horizontally, and stacked vertically to form the vertical extent of a wall, each block member comprising a bottom plate, a top plate and two side studs defining a central block opening, wherein said side by side block members abut each other and are joined by fastening plates which overlap the top of the top plates of abutting block members.

2. The wall construction of claim 1, wherein the bottom plate, top plate, side studs and fastening plates of each block member are made of wood pieces.

3. The wall construction of claim 2, wherein the wood pieces are pieces of 2×4" dimensional lumber.

4. The wall construction of claim 1, wherein the side studs of each block member are each about 15–20" in length and wherein, the bottom plates and top plates are each about 30–40" in length.

5. The wall construction of claim 1, wherein the number of block members stacked vertically in one wall construction is about five.

6. The wall construction of claim 1, wherein the overlapping fastening plates are joined to the block members by fasteners.

7. The wall construction of claim 6, wherein the fasteners are nails.

8. The wall construction of claim 6, wherein the fasteners are screws.

9. The wall construction of claim 6, wherein the fasteners are dowels, and wherein the dowels are inserted in aligned holes in the top and bottom plates, and fastening plates.

10. The wall construction of claim 1, wherein the block members are substantially free of support members in the central block openings.

11. The wall construction of claim 1, wherein the block members have a vertical brace in the central block openings.

12. The wall construction of claim 1, wherein the block members have a horizontal brace in the central block openings.

13. The wall construction of claim 11, wherein the vertical brace comprises a vertical wood piece.

14. The wall construction of claim 11, wherein the vertical brace comprises a panel extending substantially throughout the entire central opening.

15. The wall construction of claim 11, wherein the horizontal brace comprises a horizontal wood piece.

16. A wall construction, comprising block members arranged side by side horizontally, and stacked vertically about five block members high to form the vertical extent of a wall, each block member comprising a bottom plate, a top plate and two side studs defining a central opening, wherein said side by side block members abut each other and are joined by fastening plates which overlap the top of the top plates of abutting block members, said bottom plates top plates, side studs and fastening plates being made of 2×4" dimensional lumber wood pieces, said wherein said fastening plates are attached to the fastening plates by fasteners.

17. The wall construction of claim 16, wherein the fasteners are dowels inserted into aligned holes in the top and bottom plates, and fastening plates.

18. The construction of claim 16, wherein each of the block members are substantially free of support members in the central openings.

19. The wall construction of claim 16, wherein each of the block members have a brace, in the central block opening.

20. The wall construction of claim 19, wherein the brace is a panel extending substantially throughout the entire central block opening.

21. The wall construction for claim 19, wherein the brace is a vertical brace member extending between the top plate and bottom plate.

22. The wall construction of claim 21, further including a horizontal brace member extending between the side studs.

23. A wall construction comprising block sections arranged side by side horizontally, and stacked vertically to form the vertical extent of a wall, each block section defining a central block opening, wherein said side by side block sections are joined by fastening plates which overlap and overlie the top of and connect at least two adjacent block sections.

24. The wall construction of claim 23, wherein the fastening plates are horizontally oriented metal studs.

25. The wall construction of claim 23 wherein the block sections arranged side by side horizontally are defined by vertical stud members each about 15 to 20" in height.

26. The wall construction of claim 23, wherein the block sections are formed by vertical metal stud members connected at their ends to the horizontally oriented metal studs.

* * * * *